US011560741B2

(12) United States Patent
Guerin et al.

(10) Patent No.: US 11,560,741 B2
(45) Date of Patent: Jan. 24, 2023

(54) DOOR LATCH UNLOCKING DEVICE

(71) Applicant: U-Shin Italia S.p.A., Pianezza (IT)

(72) Inventors: Anthony Guerin, Pianezza (IT); Bruno Vilotta, Nevers (FR); Thomas Lanno, Nevers (FR); Emilien Desegher, Nevers (FR)

(73) Assignee: U-Shin Italia S.p.A., Pianezza (IT)

( * ) Notice: Subject to any disclaimer, the term of this patent is extended or adjusted under 35 U.S.C. 154(b) by 588 days.

(21) Appl. No.: 16/686,935

(22) Filed: Nov. 18, 2019

(65) Prior Publication Data

US 2020/0080351 A1 Mar. 12, 2020

Related U.S. Application Data

(63) Continuation of application No. PCT/EP2018/062138, filed on May 9, 2018.

(30) Foreign Application Priority Data

May 16, 2017 (EP) ..... 17171402

(51) Int. Cl.
*E05B 85/06* (2014.01)
*E05B 85/10* (2014.01)
(Continued)

(52) U.S. Cl.
CPC ..... *E05B 85/107* (2013.01); *E05B 77/34* (2013.01); *E05B 85/06* (2013.01); *E05B 17/042* (2013.01)

(58) Field of Classification Search
CPC ..... E05B 87/107; E05B 85/107; E05B 85/06; E05B 85/10; E05B 77/34; E05B 17/042;
(Continued)

(56) References Cited

U.S. PATENT DOCUMENTS

2014/0230329 A1 8/2014 Patel
2015/0233154 A1 8/2015 Smart et al.
(Continued)

FOREIGN PATENT DOCUMENTS

DE 19731325 1/1999
DE 29804105 7/1999
(Continued)

OTHER PUBLICATIONS

International Search Report for International Application PCT/EP2018/062138, dated Jun. 12, 2018.

*Primary Examiner* — Suzanne L Barrett
(74) *Attorney, Agent, or Firm* — Burris Law, PLLC

(57) ABSTRACT

A device for unlocking a door lock associated with a door handle mounted in order to slide in an aperture in the door between an inoperative position wherein the handle is flush with the door and an operative position wherein the handle projects from the door includes a cylinder supported by a holder directly or indirectly attached to the door. The cylinder is connected to an element for unlocking the lock via a part for moving the lock unlocking element, and the cylinder is mounted in the part in order to extend towards the handle at an angle to a direction normal to the door. In one form, the angle is sufficient to allow the cylinder to be introduced into the housing when the handle is in the operative position.

14 Claims, 5 Drawing Sheets

(51) Int. Cl.
*E05B 77/34* (2014.01)
*E05B 17/04* (2006.01)

(58) Field of Classification Search
CPC ..... E05B 1/0092; E05B 5/003; E05B 13/106; Y10T 70/5761; Y10T 70/5792
USPC ..... 296/1.02; 70/208, 215
See application file for complete search history.

(56) References Cited

U.S. PATENT DOCUMENTS

| | | | | |
|---|---|---|---|---|
| 2017/0159332 | A1* | 6/2017 | Beck | E05B 85/16 |
| 2019/0257124 | A1* | 8/2019 | Löw | E05B 85/103 |
| 2020/0199918 | A1* | 6/2020 | Couto Maquieira | E05B 85/14 |
| 2020/0392771 | A1* | 12/2020 | Toyama | E05B 81/34 |

FOREIGN PATENT DOCUMENTS

| | | | | |
|---|---|---|---|---|
| DE | 20109250 | | 10/2001 | |
| EP | 1262616 | | 12/2002 | |
| EP | 3020892 | A1 * | 5/2016 | B60J 5/04 |
| EP | 3032013 | | 6/2016 | |
| FR | 2895762 | | 7/2007 | |
| WO | 2001/075252 | | 10/2001 | |
| WO | WO-2004013435 | A1 * | 2/2004 | E05B 85/107 |
| WO | WO-2010032552 | A1 * | 3/2010 | B60R 25/01 |
| WO | 2014/049026 | | 4/2014 | |
| WO | 2016/058584 | | 4/2016 | |
| WO | 2016/188694 | | 12/2016 | |
| WO | WO-2017070307 | A1 * | 4/2017 | E05B 77/06 |
| WO | WO-2020153695 | A1 * | 7/2020 | B60J 5/0415 |
| WO | WO-2021210713 | A1 * | 10/2021 | E05B 77/42 |

* cited by examiner

DOOR LATCH UNLOCKING DEVICE

CROSS-REFERENCE TO RELATED APPLICATIONS

This application is a continuation of International Application No. PCT/EP2018/062138, filed on May 9, 2018, which claims priority to and the benefit of EP 17171402.5, filed on May 16, 2017. The disclosures of the above applications are incorporated herein by reference.

FIELD

The present disclosure relates to a door latch unlocking device with a flush handle, in particular, although not exclusively, a motor vehicle door latch.

BACKGROUND

The statements in this section merely provide background information related to the present disclosure and may not constitute prior art.

It is known that when a motor vehicle is equipped with a door latch associated with a flush door handle, in particular a handle mounted so as to slide in an aperture of the door between a rest position in which the handle is flush with the door and a working position in which the handle is protruding relative to the door, there is generally provided a motorization ensuring the passage from the rest position to the working position after identification of the person trying to open the door.

When the motorization fails, regardless of the reason, one should be able to open the door manually. To this end, there is generally provided a key mechanism that opens on the door wall. However, this mechanism being only rarely or even never used, there is a risk of fouling preventing the manual opening of the door. In order to prevent this risk, the end of the cylinder is covered with a sliding flap or a small cover, but this only shifts the issue, the sliding flap or the small cover being subjected to bad weather.

SUMMARY

The present disclosure provides a mechanism for unlocking a door latch that operates under usual conditions of use.

The present disclosure provides a device for unlocking a door latch associated with a door handle mounted so as to slide in an aperture of the door between a rest position in which the handle is flush with the door and a working position in which the handle is protruding relative to the door, the unlocking device including a cylinder carried by a support directly or indirectly fastened to the door, the cylinder being connected to a latch unlocking element by an operating member, in which the cylinder is mounted so as to open facing the handle in an inclined manner relative to a direction normal to the door.

Thus, during a current use of the vehicle, the inlet of the unlocking mechanism is protected by the handle, such that the risk of fouling is considerably reduced.

According to an advantageous version of the present disclosure, the inclination is sufficient to allow the cylinder to be introduced into the case from the outside of the door when the handle is in the working position.

According to another advantageous version of the present disclosure, the unlocking mechanism includes a member for coupling between the cylinder and the operating member of the latch unlocking element, the coupling member having an input axis and an output axis that extend in two different directions. Thus, it is possible to adapt the position of the cylinder to the general configuration of the door latch.

According to other characteristics of the present disclosure which can be implemented alone or in combination: the coupling member comprises bevel gears; the coupling member comprises a gimbal mounting; the coupling member comprises a bevel gear fastened to the cylinder, and a bevel gear fastened to a platen carrying a part of the gimbal mounting; the cylinder is removably mounted from the outside of the door; the coupling member comprises a first angular portion partially formed on the cylinder and a second angular portion partially formed on the operating member, the angular portions being provided to cooperate with each other; the operating member includes a longitudinal arm; the longitudinal arm carries a fastening pin; the device comprises an attached element provided to at least partially house the cylinder; the attached element has a face allowing access to the cylinder, said face being inclined relative to the direction normal to the door; the cylinder partially extends beyond the attached element in order to allow the engagement of the angular portions relative to each other. Thus, it is possible to perform finishing operations, in particular painting the door, without the risk of affecting the operation of the unlocking mechanism.

According to yet another characteristic of the present disclosure, the mechanism includes an unlocking member of the cylinder accessible by the rabbet of the door.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
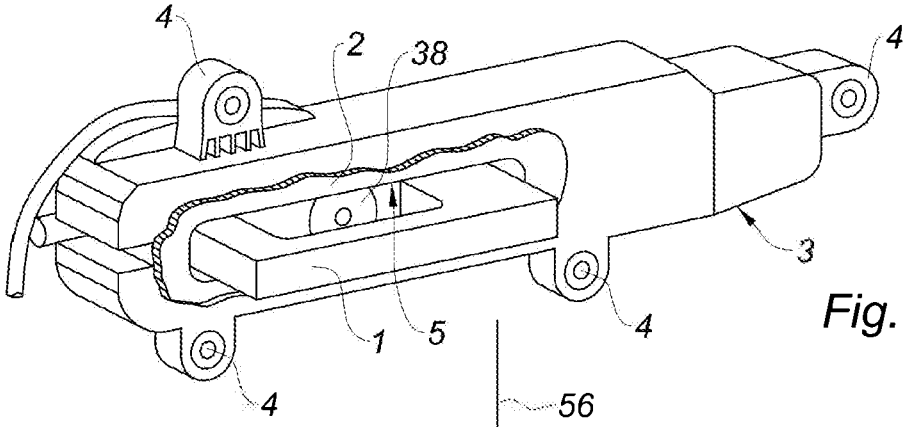
FIG. 1 is a schematic perspective view of the control mechanism of a door handle according to the present disclosure.
Figure 9A:
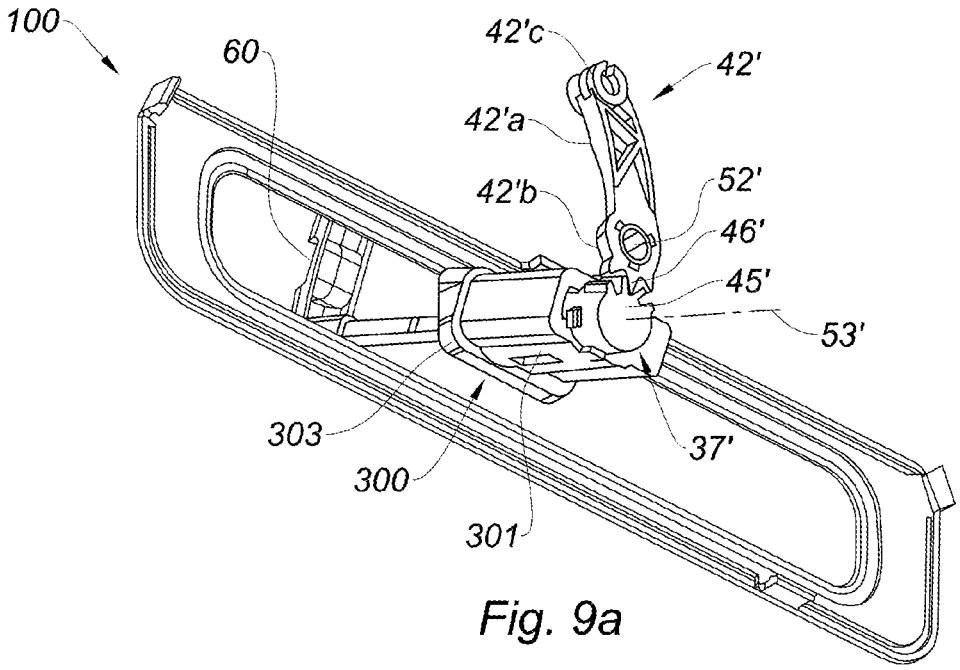
Figure 9B:
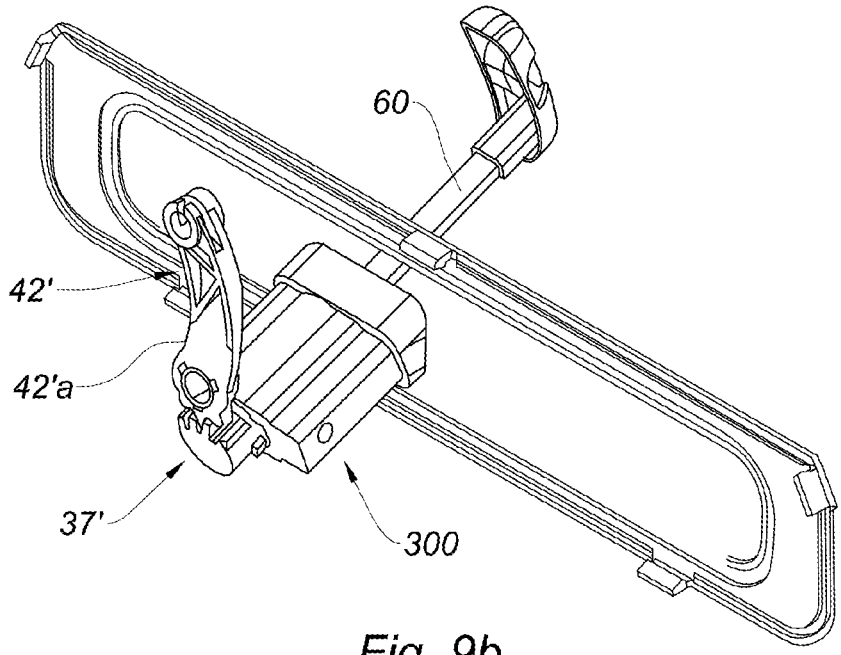
Figure 9C:
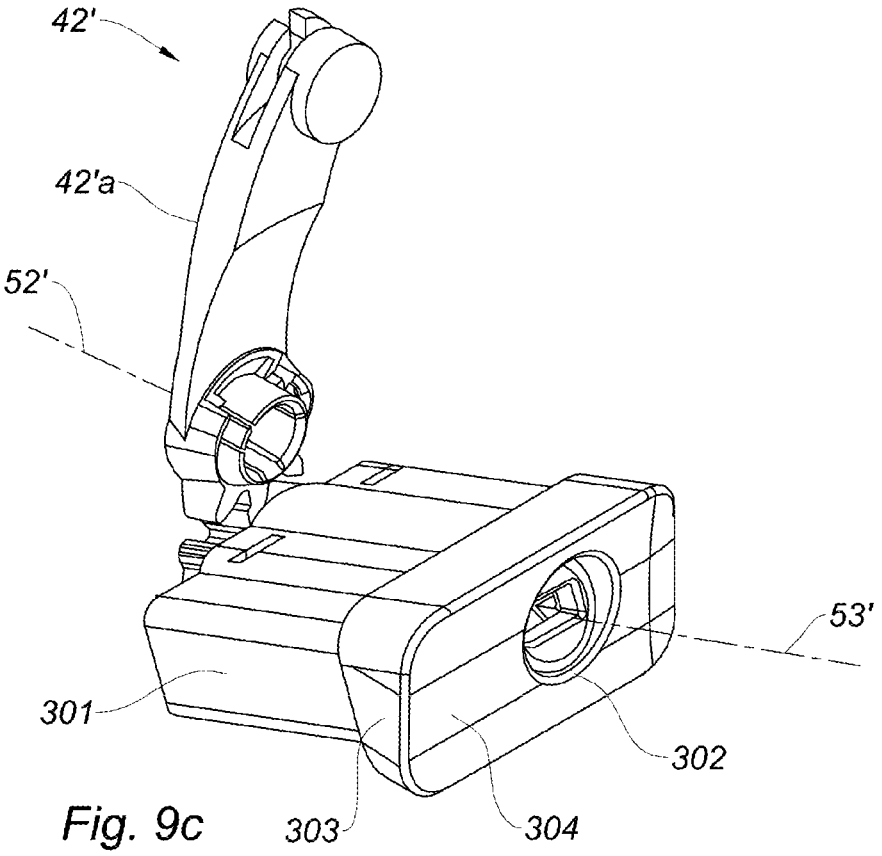
Figure 10:
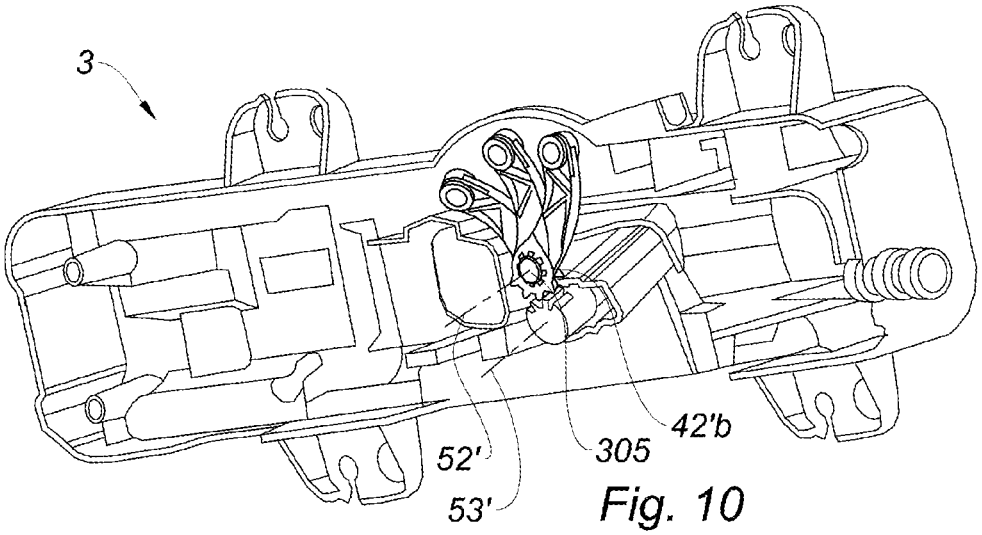

FIGS. 9*a*, 9*b* and 9*c* are schematic perspective views of a third form of the unlocking device; and FIG. 10 is a perspective view of the case of FIG. 1 seen from the back with which is associated an operating member.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to the figures, the present disclosure concerns a mechanism for controlling the handle 1 of a door 2. The handle 1 is movable between a rest position in which the handle is flush with the door, and a working position in which the handle is protruding relative to the door as illustrated in FIG. 1. The control mechanism comprises a case 3 equipped with bosses 4 for fastening the case to the door. The handle 1 is mounted so as to slide in an aperture 5 of the door.

In the illustrated form, the handle 1 is hollow. The mechanism for operating the handle includes a first lever 6 having a general Y-shape comprising a tail 7 arched towards the inside of the handle and hingedly mounted on an axis 8 carried by the handle, and two branches 9 symmetrical relative to a median plane extending in a longitudinal direction of the handle, and each having an end connected by a hinge 54 to an end of a connecting-rod 10 whose opposite end is hingedly connected to a second lever 11 by a hinge comprising an axis 12 carried by the second lever 11 and engaged in an oblong opening 13 formed in the connecting-rod and extending in the longitudinal direction of the connecting-rod. The axis 12 and the opening 13 thus provide for each connecting-rod a clearance in a longitudinal direction of the connecting-rod.

At the end opposite to the hinge with the connecting-rod 10, the second lever 11 is hingedly mounted on an axis 14 carried by the handle. The axis 14 extends parallel to the axis 8, at a distance therefrom in a longitudinal direction of the handle.

The first lever 6, the second lever 11 and the connecting-rod 10 thus make with the handle 1 a deformable quadrilateral whose deformation causes the handle to displace in translation.

Figure 6:
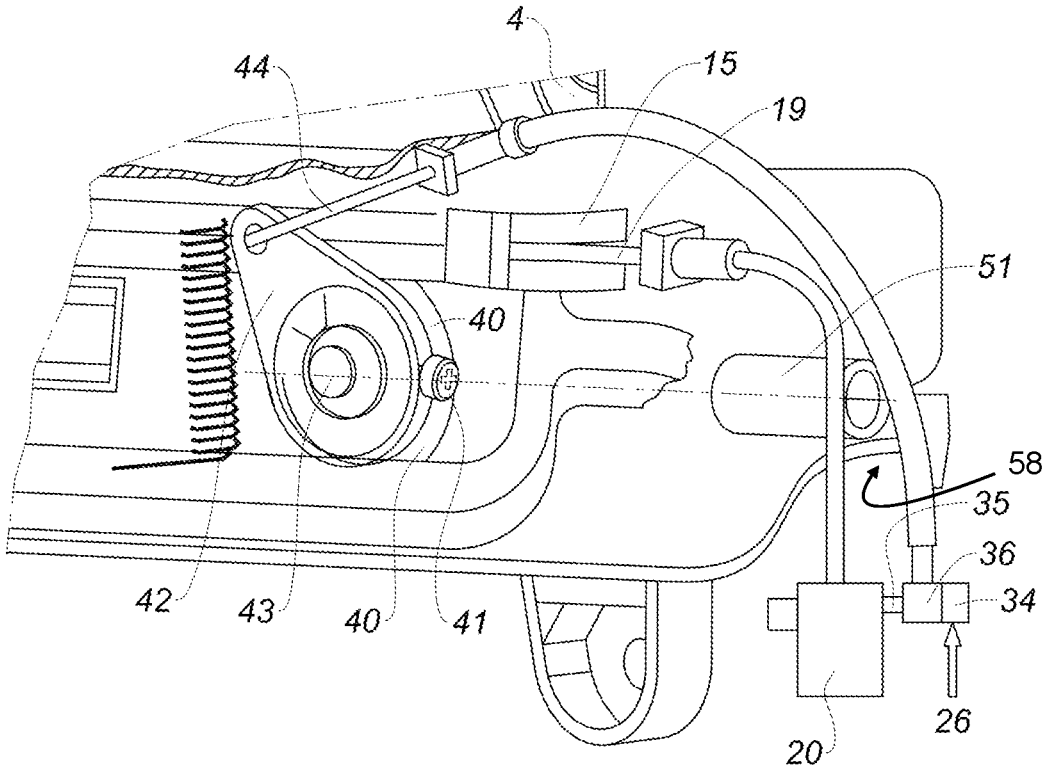
FIG. 6 is a schematic partial perspective view from the inside of the case.

Moreover, the mechanism comprises a door latch operating member comprising a plate 15 mounted so as to pivot about an axis 16 carried by the case 3 and returned by a spring 17 to a position for which an edge of the plate 15 is bearing against the inner face of the case 3. The plate 15 further includes a slot in which is engaged a head 18 of a cable 19 whose opposite end is connected to the door latch 20 (see FIG. 6). A closing state of the latch 20 corresponds to the rest position of the handle 1.

The first lever 6 also includes an operating arm 21 whose end extends facing an edge of the plate 15. At the lower end of this edge, the plate 15 includes an operating lug 22 whose function will be described below.

Figure 5:
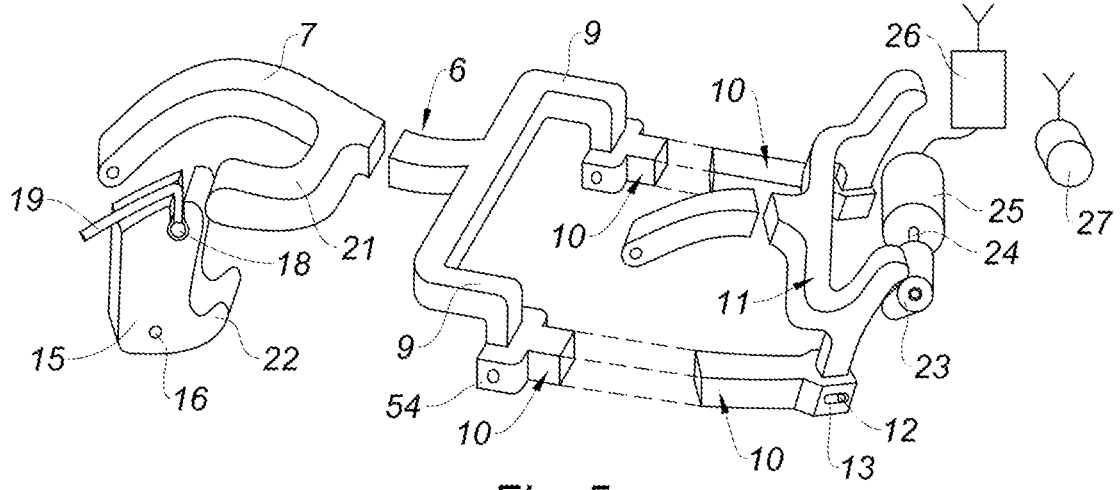
FIG. 5 is a schematic perspective view of one form of the first lever and of the second lever.

Facing an end of the lever 11 opposite to the pivot axis 14 of the second lever 11 relative to the handle 1, the mechanism includes a deployment member, here a cam 23 eccentrically mounted on an axis 24 carried by a motor 25 fastened in the case and connected to a control unit 26 capable of receiving deployment control signals from a remote control 27 (FIG. 5).

Moreover, the latch 20 includes a latch locking element activated when the handle is in the rest position.

Figure 2:
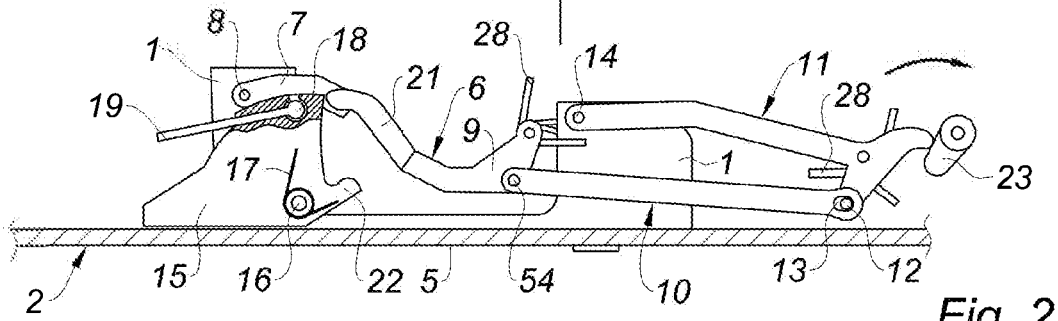
FIG. 2 is a schematic top view of the control mechanism shown outside its case for a rest position of the handle.

The operation of the mechanism according to the present disclosure is as follows: springs 28 are suitably disposed between the levers and the case so that, when associated with the return spring 17, the bearing of the operating arm 21 on the edge of the plate 15 and the bearing of the end of the lever 11 on the deployment member 23, the assembly is maintained in a stable position for which the handle 1 is flush with the aperture 5, as illustrated in FIG. 2.

Figure 3:
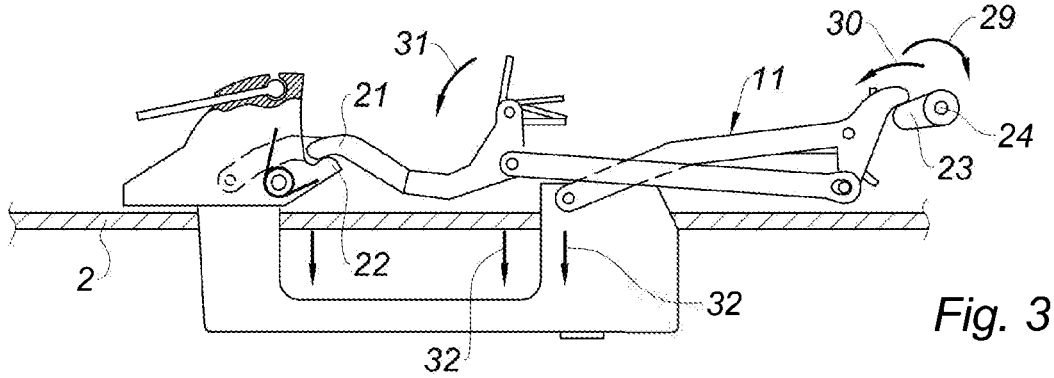
FIG. 3 is a view similar to that of FIG. 2 for a working position of the handle.
Figure 4:
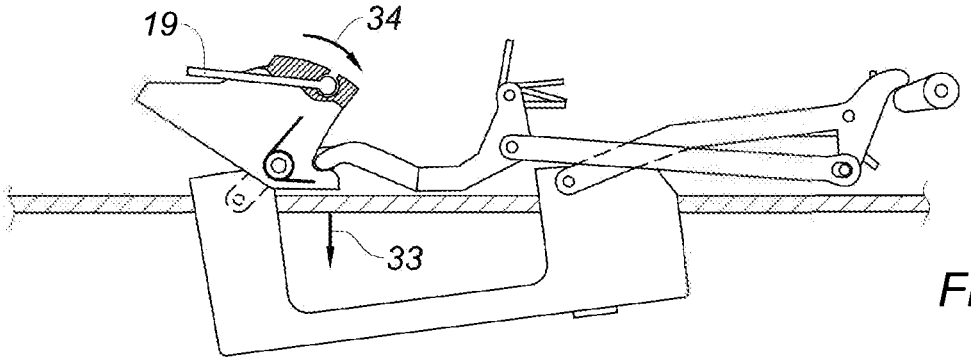
FIG. 4 is a view similar to that of FIG. 2 when the handle is actuated in a direction of opening of the door.

When a deployment control signal is sent to the electric motor 25 by the control unit 26, the deployment member 23 is driven in rotation as illustrated by the arrow 29 in FIG. 3 such that the levers 6 and 11 are tilted as indicated by the arrows 30 and 31 in FIG. 3. In this movement, the handle 1 displaces in translation as indicated by the arrows 32, until the operating arm 21 bears against the operating lug 22. Simultaneously, an unlocking signal is sent to an electrical unlocking member 34 associated with the latch 20. From this position, a traction performed on the handle as indicated by the arrow 33 in FIG. 4 tilts the plate 15 as indicated by the arrow 34 in FIG. 4 such that a traction is exerted on the cable 19 which opens the door latch 20.

In the case where the electrical operation is faulty, a manual pressure on the handle in vertical alignment with the axis 14 causes a slight tilting of the lever 6, sufficient to engage the hand in the handle and exert a traction thereon.

Simultaneously it is desired to provide an unlocking of the latch.

To this end, the mechanism according to the present disclosure comprises an unlocking device including a cylinder 37 carried by a support directly or indirectly fastened to the door, here a ring 40 fastened in the case and in which the cylinder 37 is maintained blocked by a screw 41 screwed in the ring 40 and whose end bears in a groove 39 of the cylinder 37. The screw 41 is preferably disposed so as to be accessible from the rabbet 58 of the door, by passing a screwdriver into a tube 51 which opens into the rabbet 58 of the door. The cylinder 37 includes an aperture 38 for the introduction of a key 55. The cylinder 37 is connected to the unlocking element 35 of the latch by an operating member 42, here a lock lever 42 mounted so as to pivot on an axis 43 carried by the case and connected to the unlocking member 36 by a cable 44.

Figure 7:
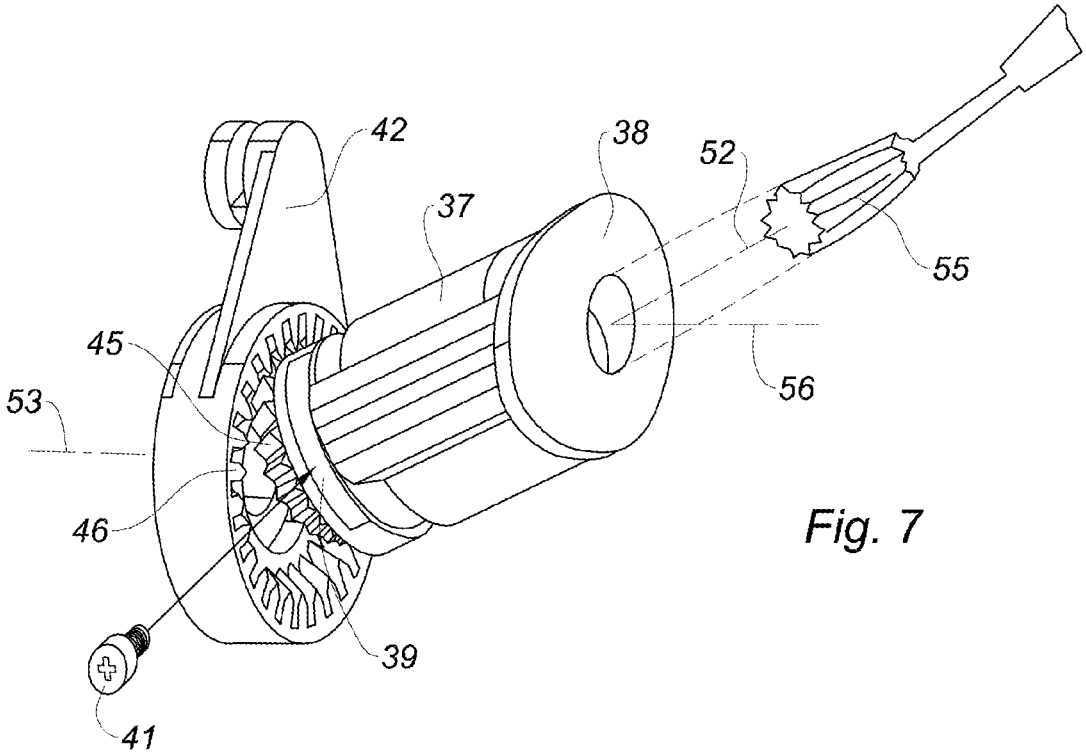
FIG. 7 is a perspective view of the door latch unlocking device according to a first form of the means for coupling the cylinder and the lock lever.

In the form of FIG. 7, the lock lever 42 is connected to the cylinder 37 by a coupling member comprising a male bevel gear 45 carried by the cylinder 37, and a female bevel gear 46 carried by the lock lever 42.

The coupling member thus has an input axis 52 and an output axis 53 which extend in two different directions. By a suitable choice of the direction of the output axis, the coupling can therefore be adapted to the arrangement of the different elements contained in the case.

Figure 8:
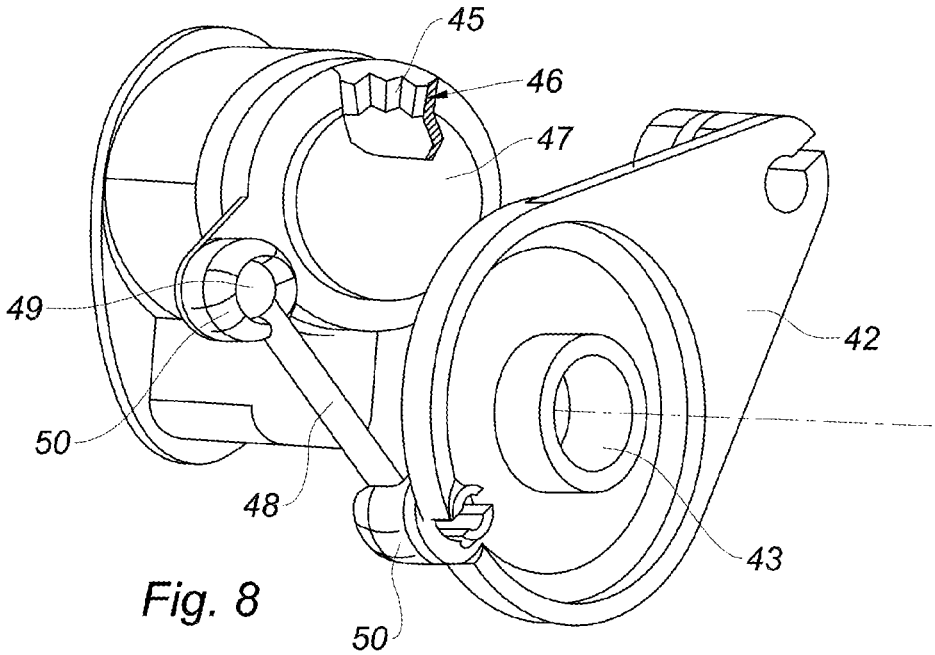
FIG. 8 is a schematic perspective view of a second form of the unlocking device.

In the form of FIG. 8, the female gear 46 is carried by a platen 47 connected to the lock lever 42 by a gimbal mounting comprising a lever 48 carrying at each of its ends a ball-joint 49 engaged in a ball-joint support 50.

In the form shown in FIGS. 9*a*, 9*b* and 9*c*, there is shown only a frame 100 of the handle 1 as well as the unlocking device, in order to facilitate the understanding of the present disclosure.

In this third form, the input axis 52' and the output axis 53' of the coupling member 45', 46' extend in two different directions and the coupling member 45', 46' is comprised between the cylinder 37' and the operating member 42' of the latch unlocking element 35. In a manner distinct from the previous forms, the coupling member 45', 46' comprises a first angular portion 45' partially formed on the cylinder 37' and a second angular portion 46' partially formed on the operating member 42', the angular portions 45', 46' being provided to cooperate with each other. It will be understood that unlike the previous forms, the angular portions 45', 46' are formed only on a peripheral angular portion respectively of the cylinder 37' and the operating member 42'. Each angular portion 45', 46' is formed by gear teeth provided to be engaged with each other. The angular portion 45' of the cylinder 37' is preferably formed at its end.

The operating member 42' here comprises a longitudinal arm 42'*a* extending from the second angular portion 46' in a rectilinear direction perpendicular to the input axis 52' or alternatively in a curved direction as shown. Such an arm 42'*a* advantageously allows clearing a space around the cylinder 37'. The longitudinal arm 42'*a* is then delimited between, on the one hand, the second angular portion 46' and, on the other hand, a hooking element 42'*c* of the cable 44 connected to the unlocking member 36. Moreover, the longitudinal arm 42'*a* comprises a fastening pin 42'*b* in order to mechanically connect the operating member 42' to the case 3 fastened to the door. The fastening pin 42'*b* allows the pivoting of the operating member 42' when the cable is actuated. The fastening pin 42*b'* is advantageously adjacent to the angular portion 46' of the operating member 42'. More particularly, the angular portion 46' of the operating member 42' extends from the fastening pin 42'*b*.

As shown, the cylinder 37' is at least partially housed in an attached element 300 distinct from the door. The attached element here has a rectangular shape without this being limiting. The attached element 300 advantageously surrounds the cylinder 37' for the protection thereof. This attached element 300 is formed of a body 301 comprising a housing for receiving 302 the cylinder 37. When the cylinder 37 is housed in the body 301, its angular portion 45' formed at its end can then engage with the angular portion 46' of the operating member 42'. The body 301 of the attached element 300 carries a head 303, preferably a flat head, having a face 304 allowing access to the cylinder 37 and which is inclined relative to the direction normal 56 to the door in order to facilitate the access to the cylinder, in this case using an unlocking key 60, this particularly in the case of a latch which is sliding and flush with the door.

In FIG. 10, there is shown the case 3 fastened to the door which includes a protrusion 305, preferably a cylindrical protrusion. The protrusion 305 is provided to be received in the fastening pin 42'*b* and to allow the pivoting of the operating member 42'*b* about the input axis 52'. For example, the operating member 42'*b* is shown in three positions of rotation.

Of course, the present disclosure is not limited to the described forms and is capable of variant forms that will be apparent to those skilled in the art without departing from the scope of the present disclosure as defined by the claims.

Particularly, although in the form of the present disclosure the cylinder 37 is introduced from the front face of the door, which allows performing finishes before placing the cylinder 37, it is interesting to make the cylinder 37 open behind the handle 1 in order to protect the mechanism associated with the key 55 against fouling.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice; material, manufacturing, and assembly tolerances; and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A device comprising:

a door handle mounted so as to slide in an aperture of a door between a rest position in which the door handle is flush with the door and a working position in which the door handle is protruding relative to the door;

a mechanism for operating the door handle, the mechanism comprising a first lever and a second lever articulatably coupled to the handle and linked by a connected rod to form, with the handle, a deformable quadrilateral, wherein the deformable quadrilateral is configured such that deformation of the deformable quadrilateral causes the handle to displace in translation; and a cylinder carried by a support configured to be directly or indirectly fastened to the door, the cylinder being connected to a latch unlocking element by an operating member, the cylinder including a key aperture configured to receive a key, wherein the cylinder is mounted so that the key aperture faces the handle at an incline relative to a direction normal to the door.

2. The device according to claim 1, wherein the incline is sufficient to allow the cylinder to be introduced into the case from outside the door when the handle is in the working position.

3. The device according to claim 1 further comprising a coupling member between the cylinder and the operating member of the latch unlocking element, the coupling member having an input axis and an output axis that extend in two different directions.

4. The device according to claim 3, wherein the coupling member comprises bevel gears.

5. The device according to claim 3, wherein the coupling member comprises a gimbal mounting.

6. The device according to claim 3, wherein the coupling member comprises a bevel gear fastened to the cylinder, and a bevel gear fastened to a platen carrying a part of a gimbal mounting.

7. The device according to claim 3, wherein the coupling member comprises a first angular portion partially formed on the cylinder and a second angular portion partially formed on the operating member, the angular portions being provided to cooperate with each other.

8. The device according to claim 1, wherein the operating member includes a longitudinal arm.

9. The device according to claim 8, wherein the longitudinal arm carries a pin for fastening to a case of the door.

10. The device according to claim 1 further comprising an attached case that at least partly houses the cylinder.

11. The device according to claim 10, wherein the attached case has a face allowing access to the cylinder, said face being inclined relative to the direction normal to the door.

12. The device according to claim 1 further comprising a coupling member between the cylinder and the operating member of the latch unlocking element, the coupling member having an input axis and an output axis that extend in two different directions, wherein the coupling member comprises a first angular portion partially formed on the cylinder and a second angular portion partially formed on the operating member, the angular portions being provided to cooperate with each other, and the cylinder extends partially beyond the attached case in order to allow engagement of the angular portions relative to each other.

13. The device according to claim 1, wherein the cylinder is removably mounted from outside the door.

14. The device according to claim 13 further comprising a member for unblocking the cylinder accessible from a rabbet of the door.

* * * * *